United States Patent [19]

McLuskie et al.

[11] 4,343,069

[45] Aug. 10, 1982

[54] FIBER CUTTING MACHINE

[75] Inventors: Albert McLuskie, Aukrug-Buenzen; Johann Ratjen, Willenscharen; Ernst Vehling, Bordesholm, all of Fed. Rep. of Germany

[73] Assignee: Neumuenstersche Maschinen- und Apparatebau GmbH (NEUMAG), Neumuenster, Fed. Rep. of Germany

[21] Appl. No.: 190,821

[22] Filed: Sep. 25, 1980

[30] Foreign Application Priority Data

Sep. 27, 1979 [DE] Fed. Rep. of Germany ..... 2939154

[51] Int. Cl.[3] ..... D01G 1/04

[52] U.S. Cl. ..... 19/0.6; 83/913

[58] Field of Search ..... 19/0.6, 0.62, 0.64, 19/0.3; 83/913

[56] References Cited

U.S. PATENT DOCUMENTS 3,062,082 11/1962 Keith ..... 19/0.6

FOREIGN PATENT DOCUMENTS 730842 3/1966 Canada ..... 19/0.6

2752068 5/1979 Fed. Rep. of Germany ..... 19/0.6

43-10725 5/1968 Japan ..... 19/0.6

*Primary Examiner*—Louis Rimrodt

*Attorney, Agent, or Firm*—Michael J. Striker

[57] ABSTRACT

A machine for cutting a travelling tow of synthetic plastic filaments to produce staple fibers has a blade carrier from which cutting blades project and have their free ends secured to a concentric surrounding ring. The facing annular surfaces of ring and carrier are shaped to resemble portions of a hollow and of a solid sphere, respectively, and together define an annular cutting channel. A tow pressing ring is arranged skew to the axis of this channel, so that it enters into the channel at one side but is spaced from and defines with the inlet to the channel a gap at the opposite side. One or the other of the carrier and ring is positively rotated. When tow is fed through the gap into the channel it forms on the carrier one or more convolutions which are progressively pressed deeper into the channel by the pressing ring until they reach and are cut by the cutting blades.

15 Claims, 4 Drawing Figures

FIBER CUTTING MACHINE

BACKGROUND OF THE INVENTION

This invention relates to a fiber cutting machine, and more particularly to a machine for cutting a fibrous tow, usually a tow of synthetic plastic filaments into staple fibers, i.e., for severing it into sections of reduced length.

A machine of this type is already known from German Published Application OS No. 2,809,592 which uses a rotary cylinder from which cutter blades project in radial direction. A stationary tow guiding ring coaxially surrounds the cylinder and the tow is guided between the ring and the cylinder to form convolutions which are cut-through by the blades. This machine has many advantageous aspects, such as its structural simplicity, exact operation and low blade wear. It does, however, have the problem that sliding friction develops between the stationary ring and the tow convolutions which participate in the rotation of the cylinder. At the high operating speeds which are now required of these machines to make their use economically feasible, this sliding friction tends to cause heating of the materials involved and may lead to consequent damage to these materials. This is aggravated by the fact that the advancement of the convolutions on the cylinder generates additional friction.

Another machine for the same purpose is described in British Pat. No. 1,424,178. It uses a circular plate carrying an annulus of axially parallel blades having outwardly facing cutting edges. The tow guiding ring surrounds the plate with its own axis parallel but eccentric relative to the axis of the plate so that at one side its inner surface is very close to the cutting edges whereas at the opposite side there is a sickle-shaped clearance between them. In this machine the ring is turnably mounted so that the sliding-friction problem mentioned above is avoided. However, the area of contact between the ring and the tow convolutions is relatively small, which results in a somewhat uneven operation and rather high blade wear.

SUMMARY OF THE INVENTION

The present invention has the general object of overcoming the disadvantages of the prior art.

A more particular object of the invention is to provide an improved fiber cutting machine in which frictional forces resulting from coaction of the tow with various machine components are reduced or eliminated.

Still a further object is to provide a fiber cutting machine of the type under discussion, in which the tow-guiding and pressing ring acts upon the tow convolutions over a larger angular range than heretofore known.

Pursuant to these objects and still others which will become apparent hereafter, one aspect of the invention resides in a fiber cutting machine. Briefly stated, such a machine may comprise a combination including a rotationally symmetrical blade carrier having a circumferential first surface shaped in conformance with a portion of a sphere; a plurality of cutting blades on the carrier, circumferentially distributed thereabout and having portions projecting therefrom; a mounting ring secured on the portions of the blades and having a circumferential second surface shaped in conformance with a portion of a hollow sphere concentric to the first surface and defining therewith an annular channel across which the blades extend; a tow pressing ring extending at one side of the channel into the same and close to the blades, and being at the opposite side of the channel located outside the same and in part defining a tow inlet gap communicating with the channel, the pressing ring having an axis which is inclined to an axis of the blade carrier and intersects it at the center of curvature of the spheres; and means rotatably mounting at least one of the blade carrier and pressing ring with freedom of adjusting its speed of rotation to the other of the pressing ring and blade carrier, respectively.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
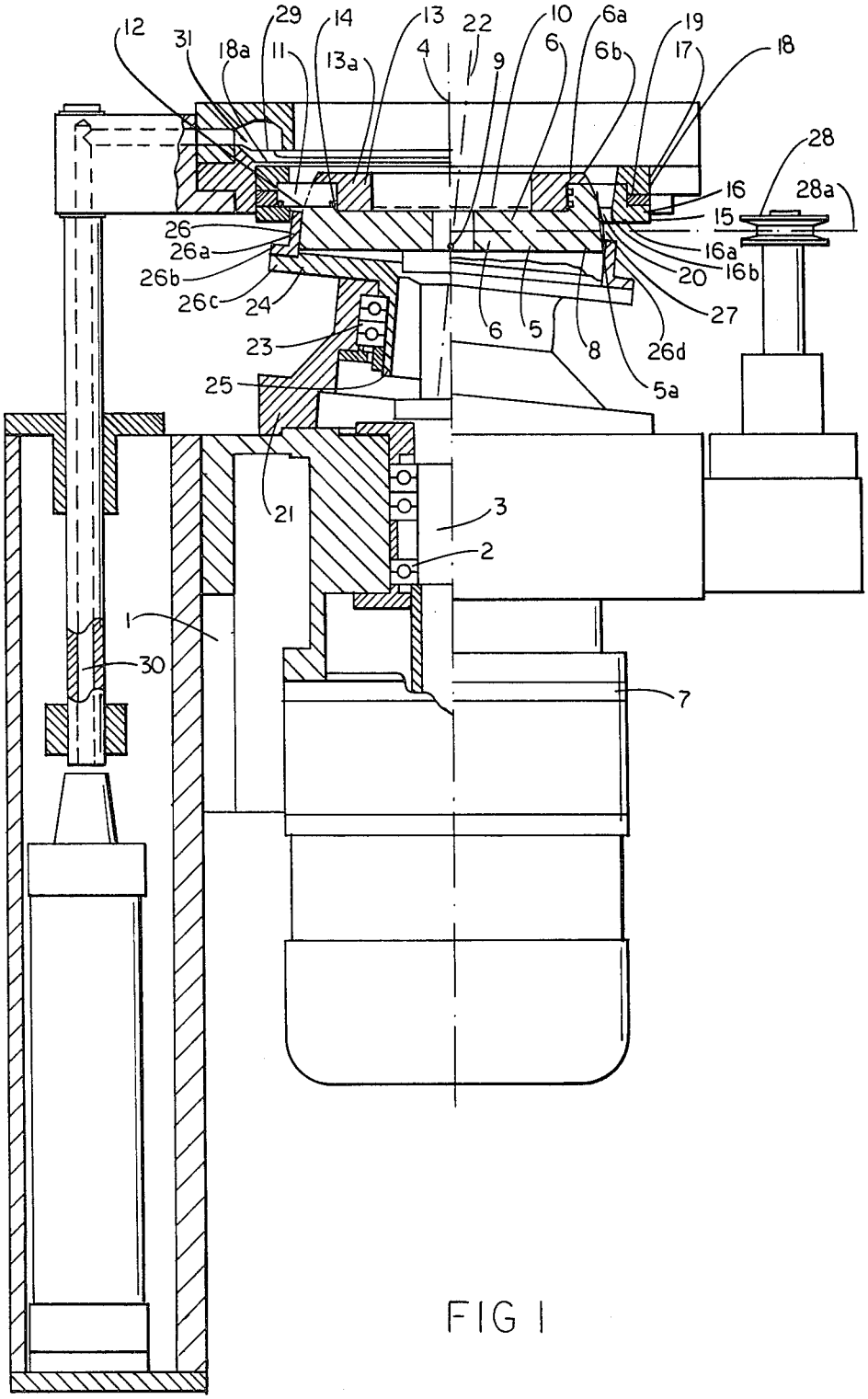
FIG. 1 is a partly sectioned side view, illustrating one embodiment of the invention.

A first embodiment of the invention is illustrated in FIG. 1 where a shaft 3 is journalled in a machine frame 1 in a bearing 2, so that it can rotate about the axis 4 when driven by an electric motor 7. The free end of shaft 3 supports a blade carrier 5 in form of a disk 6 the upper surface of which is provided with an outer annular collar 6*a*. The circumferential edge face of the disk 6 and the corresponding edge face of the collar 6*a* are shaped so as together to define a part-spherical (convex) zone 5*a* the center of curvature of which is designated with reference numeral 9. The lower endface 8 of disk 6 is located in a plane which intersects the axis 4 in or near the center of curvature 9.

The annular collar 6*a* is provided with a plurality—e.g., seventy-two—of axial slots which are equi-angularly spaced about the axis 4 and extend from the axial endface 6*b* of collar 6*a* to a plane 10 which parallels the plane endface 8. Each of these slots—or, depending upon the desired staple fiber length, only some of them—accommodates a short cutter blade 11. The cutting edges 12 of these blades 11 extend radially of the axis 4 so as to enclose therewith an angle of 90° ; they face towards the plane of endface 8 and are all located in the plane 10 which is spaced from the plane of endface 8. The distance between plane 10 and center of curvature 9 corresponds to about one quarter of the radius of the (imaginary) sphere of which the point designated with reference numeral 9 forms the center.

Blades 11 are retained by a ring 13 which is located within the confines of collar 6*a* and secured to plate 6 by, e.g., not-illustrated screws. Ring 13 has a radially outwardly projecting annular flange 13*a* which overlies the upper endface 6*b* of collar 6*a* and thus also the radially inner ends of the blades 11. To counteract any tendency towards loosening, a ring 14 of tough but elastically yieldable material (e.g., one of the known per se synthetic plastics) is provided between the components 6*a* and 13; the inner ends of the blades 11 are provided with appropriate cut-outs to receive the ring 14.

Mounted on the radially outer ends of the blades 11 is a ring 15 which, for ease of manufacture and assembly, is here composed of three discrete annular elements 16, 17 and 18. Element 16 has a cylindrical part 16*a* and a flange part 16*b*, the former being provided with radial slots corresponding to those in collar 6*a* and accommodating the radially outer end portion of the blades 11. Element 16 is retained on the blades 11 by the annular retaining element 18 which in part overlies the radial slots in part 16*a* and which is secured (via, e.g., not-illustrated screws) to the element 16, the element 17 being interposed between them. A ring 19 is provided which corresponds in function and material to the ring 14.

A portion of the inner surface of ring 15 defines with the convex zone 5*a* of carrier 5 adjacent the exposed portions of the cutting edges 12, an annular channel 20. This portion of the inner surface of ring 15 is preferably shaped to resemble a hollow sphere concentric to the curvature of the zone 5*a*. However, since the axial length of this portion of the inner surface of ring 15 is rather short and no particularly high manufacturing tolerances need be observed, it will generally suffice if this surface portion is of a conical configuration which is not too far removed from the (ideal) hollow-spherical shape. In either case the axial length of the channel 20 is so short that in an axial sectional view the two surface portions bounding the channel at the radially inner and outer sides thereof will appear as essentially parallel short lines. Behind (above) the plane 10 the distance between carrier 5 and ring 15 increases, so that a relatively wide annular clearance exists, as shown, which is unobstructed above the blades 11.

A housing 21 is rigidly connected with the frame 1 and has a center axis 22 which intersects the axis 4 in the center of curvature 9 and includes with the axis 4 an angle of about 5°. To achieve this inclination the endface of the housing 21 which is connected to and in engagement with the frame 1 is inclined as shown. A circular disk 24 is located at the upper end of housing 21 and has a tubular extension 25 which is journalled in housing 21 by means of anti-friction bearings 23 and surrounds (but does not contact) the shaft 3.

Mounted on the disk 25 is the tow guiding and directing (pressing) ring 26 which is composed of a flange portion 26*b* secured (e.g., by the diagrammatically shown screws) to the disk 24, and of a thin-walled cylindrical portion 26*a*. A short (in axial direction) part of the inner surface of portion 26*a*, namely the part adjacent the disk 24, is of cylindrical shape; the remainder of this surface is shaped to resemble a part of a hollow sphere having a center of curvature which coincides with the center 9 and surrounding the zone 5*a* with slight play.

Because of the inclination of the disk 24 and axis 22 the cylindrical portion 26*a* of ring 26 extends axially into the channel 20 at one side of axis 22 (in FIG. 1 at the left-hand side); the wall thickness of portion 26*a* is chosen to permit this. At the opposite side, the portion 26*a* does not enter the channel 20; in fact, the axial endface 26*d* of portion 26*a* is at this opposite side far enough spaced from the proximal edge of ring 15 to define therewith a gap 27 having a width (in direction lengthwise of axis 4) which corresponds approximately to the axial length of the channel 20. The outer circumferential surface of portion 26*a*, or at least that portion thereof which can enter into the channel 20 is of part-spherical (convex) shape. The axial endface 26*b* is not planar but is, instead, slightly conical in shape so that at the location (left-hand side in FIG. 1) where portion 26*a* enters most deeply into the channel 20, the endface 26*d* will be exactly parallel to the cutting edge of edges 12 located opposite it. As the left side of FIG. 1 shows clearly, the spacing between cutting edges 12 and endface 26*d* is small at this location, compared to the axial length of the channel 20.

Laterally adjacent the device, at the side of gap 27, there is mounted a turnable roller 28 having a circumferential groove. The center or plane of symmetry 28*a* of the roller 28 is located intermediate the plane 10 in which cutting edges 12 are located and a plane which is parallel to plane 10 and passes through the center of curvature 9. The roller 28 is so positioned that a rope-like fibrous tow (not shown) which is fed via it to the cutting device, runs tangentially onto the blade carrier 5 in the area in which the gap 27 has its greatest axial width. A small distance above the upper endface 18*a* of the annular element 18 an inwardly directed annular nozzle 29 is provided, which receives compressed gaseous fluid (e.g., air) via a line 30 and a distributing channel 31.

In operation, a rope of fibrous tow having a thickness not much smaller than the cross-section of channel 20, is fed via roller 28 tangentially and under low tension to the rotating blade carrier 5. The latter acts as a winding core or mandrel, i.e., a convolution of the tow forms on the zone 5*a*. During the first half revolution of carrier 5, the newly forming convolution is pushed axially into the channel 20 as it slides over the endface 26*d* of ring 26; this advancement into the channel 20 is considerably facilitated by the part-spherical shape of zone 5*a*, i.e., by the fact that the diameter of carrier 5 decreases in the direction of advancement of the convolution in the channel 20.

During the further revolution of carrier 5 the tow convolution becomes clamped in the space between the cutting edges 12 and the endface 26*d* of ring 26, which space, of course, decreases in circumferential direction of the carrier 5, and the tow is pressed progressively against the cutting edges 12 over a wide angular range until it is finally cut (to form staple fibers) in the vicinity of the location where the endface 26*d* is closest to the cutting edges 12. The pressure of fewer than two complete convolutions of tow on the carrier at any one time is sufficient to ensure proper functioning of the device.

Ring 26 is not driven but is freely turnable about its axis 22. It is frictionally entrained (static friction) by the tow running onto the carrier 5 from roller 28, so that its speed of rotation automatically accommodates itself to the speed of rotation of the carrier 5. This eliminates sliding friction between the tow and the ring 26 and prevents the attendant wear.

Figure 2:
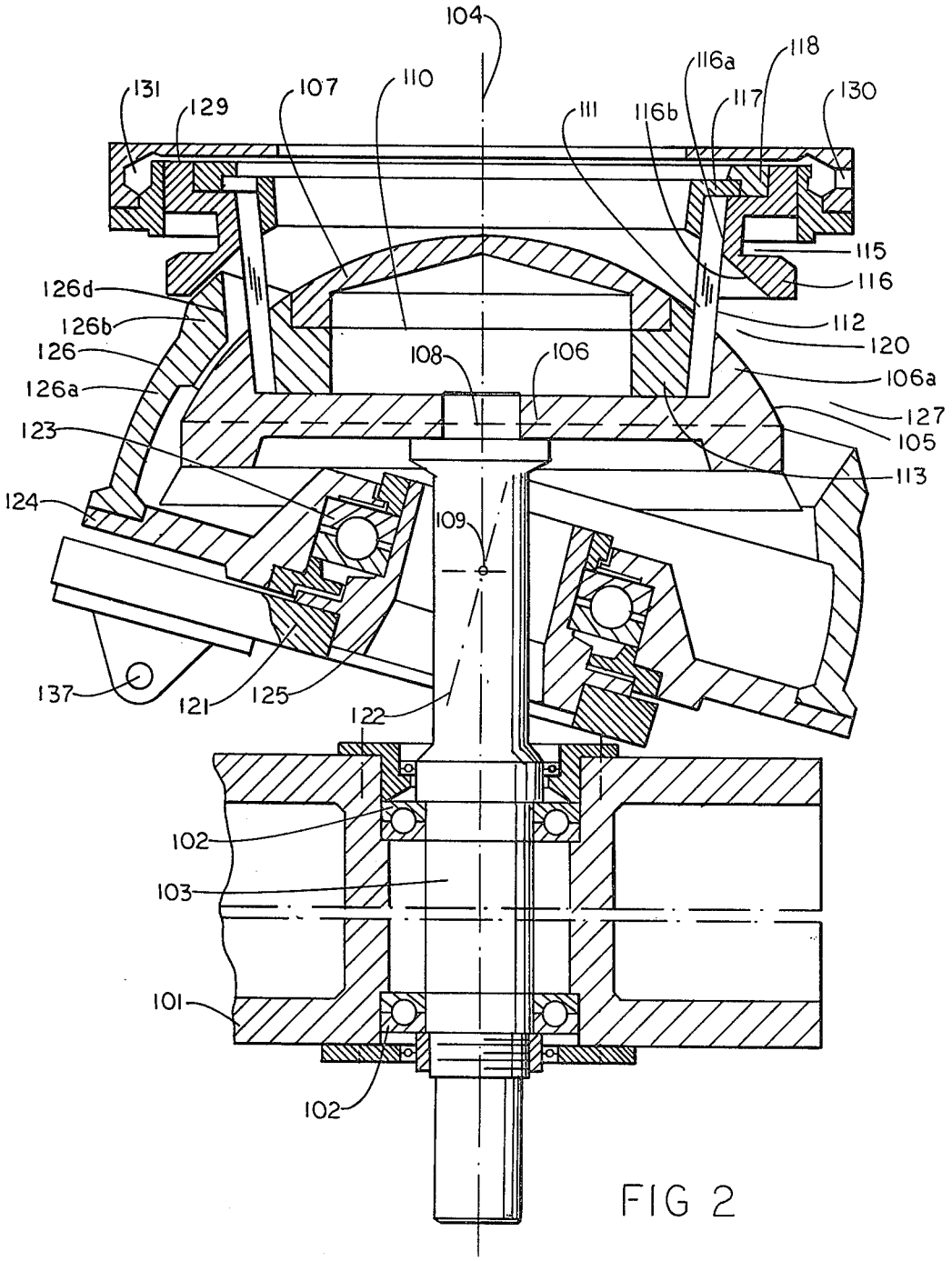
FIG. 2 is a partly sectioned detail view, illustrating details of another embodiment.
Figure 2A:
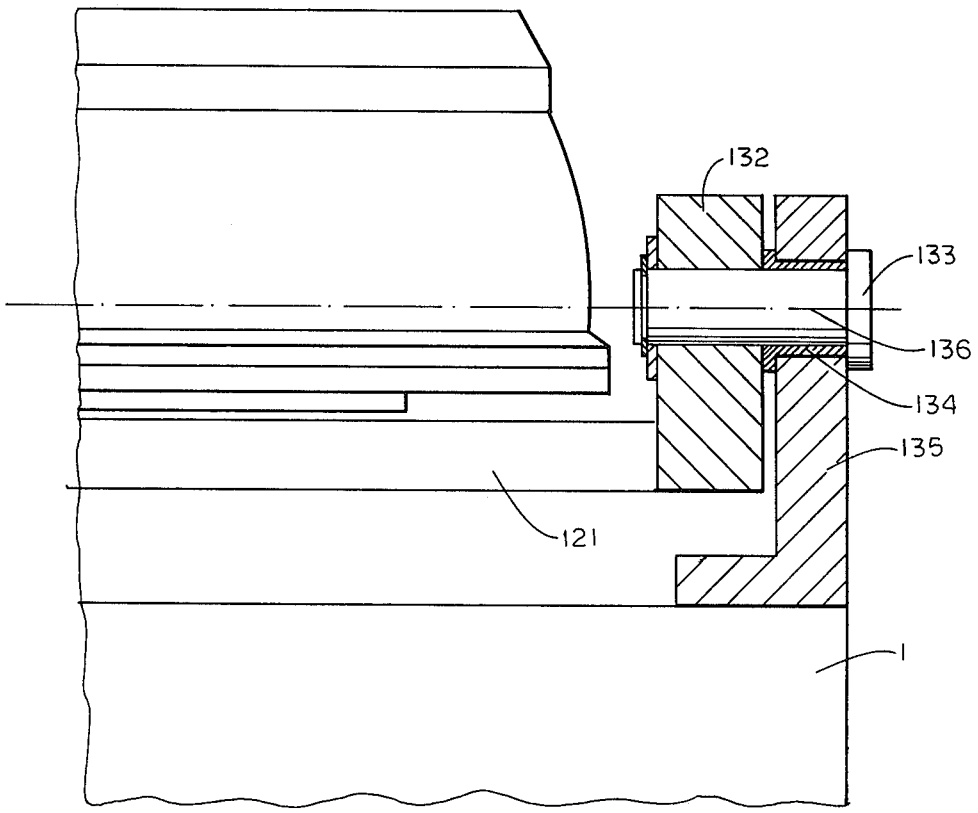
FIG. 2*a* is a sectional view on an enlarged scale, showing a detail of FIG. 2 with the section being taken in a plane normal to the plane of FIG. 2.

A second embodiment of the invention is illustrated in FIGS. 2 and 2*a*. Here, the machine frame 101 mounts shaft 103 by means of anti-friction bearings 102. Shaft 103 is turnable about its axis 104 and driven in rotation in suitable manner, e.g., by a not-illustrated electric motor. The free end of shaft 103 carries blade carrier 105 which is composed of a disk 106 having at its upper side an outer circumferential roller 106*a*. The circumferential edgeface is again configurated as a part-spherical zone 105*a* having a center of curvature located at 109. The lower edge of zone 105*a* is located in a plane 108 which is spaced from center 109 by a distance just barely equal to half of the radius of the (imaginary) sphere. The upper edge of zone 105*a* is located in a plane 110 which is spaced from center 109 by about 0.7 times the radius of the sphere.

A retaining ring 113 is received within the collar 106*a* and connected to disk 106 by only diagrammatically illustrated screws. Its outer surface is provided with a plurality of generally axial equi-angularly spaced slots which are open in radially outward direction; these slots are inclined to the axis 104 so as to include with the same an angle of about 5°. Each (or at least some) of the slots contain a cutting blade 111; the radially outwardly facing cutting edges 112 of these blades are also inclined at about 5° to the axis 104 and those portions of the blades 111 which project out of the slots are inclined in radially outward direction, as shown. A cap 107 covers the ring 113 (e.g., being connected thereto by snap action, or as shown by screws) and the outer exposed surface portion of ring 113 and cap 107 complete the zone 105*a* to the illustrated calotte shape.

A ring 115 is mounted on the outer projecting end portions of the blades 111. It is composed of annular members 116, 117 and 118. Member 116 has an inner conical surface 116*a*, the cone angle of which corresponds to the angle included between the cutting edges 112 and the axis 104; this assures that the upper end portions of the cutting edges 112 are in full contact with the surface 116*a*. The surface 116*a* is followed by a surface 116*b* shaped to resemble a portion of a hollow sphere and to surround the zone 105*a* concentrically and with clearance. Opposite the cutting edges 112, the zone 105*a* and the surface 116*b* form an open annular channel 120, the sidewalls of which include with the cutting edges 112 angles of about 50°. A retaining ring 117 is mounted within the confines of surface of 116*a* and provided with equi-angularly spaced radial slots in which the upper end portions of the blades 111 are received. A radially outer flange of ring 117 overlies the upper ends of the blades. A ring 118 overlaps the ring 117 to hold it in place and is itself connected via the diagrammatically illustrated screws to the ring 116. Rings 114 and 119 are of the same material—and have the same function—as the rings 14, 19 in FIG. 1. An annular nozzle 129 and distributing channel 131 are provided directly on the ring 115; on inlet serves to connect channel 131 to a source (not shown) of gaseous fluid, e.g., compressed air.

A plate 121 has a hole in which a tubular socket 125 is installed, being connected to plate 121 via only diagrammatically shown screws. Socket 125 surrounds but does not touch the shaft 103. It has an axis 122 which extends normal to the plane of plate 121 but is inclined at an angle of 15° to the axis 104 which it intersects in the center 109. Another plate 124 is freely turnably journalled on socket 125 via anti-friction bearings 125; a tow pressing ring 126 is screwed to this plate 124. As the drawing shows, the ring 126 is composed of a relatively thin-walled annular part 126*a* and a thicker upper marginal part 126*b*. The outer surface of at least the part 126*b* is shaped as a part of a sphere; the inner surface of the same part 126*b* is shaped as a part of a hollow sphere. They are thus accommodated with a small amount of play to the zone 105*a* and the surface 116*b*, respectively.

At one side (the left side in the drawing) the ring 126 enters deep into the channel 120; at the opposite side the channel 120 is open due to the inclination of the axis 122 and a broad gap 127 remains between the endface 126*d* of ring 126 and the lower edge of ring 115. The endface 126*d* is conically shaped so that at the location where the ring 126 enters most deeply into the channel 120, i.e., at the left side in FIG. 2, the endface 126*d* is parallel or substantially parallel to the juxtaposed cutting edge 112.

In this embodiment the angle included between the axes 104, 122 and thus the depth to which ring 126 enters into the channel 120, can be varied by tilting the plate 121 about an axis 136 which extends normal to the plane of FIG. 2. As more clearly shown in FIG. 2*a*, the plate 121 is provided with two arms 132 (only one shown) which extend normal to it and of which one is located (in FIG. 2) forwardly of the drawing plane whereas the other is located rearwardly of the drawing plane, neither being visible in FIG. 2. Arms 132 may be welded or otherwise secured to plate 121 and mount the plate on lugs 135 of frame 1 via pins 133 and bushings 134, so as to be tiltable about the axis 136. The underside of plate 121 has mounted on it a lug 137 in a hole of which a portion (e.g., a bifurcated member) of a tilting device (e.g., screw spindle or cylinder unit) is engageable to tilt the plate 121 about axis 136.

A roller (not shown) similar to tow roller 28 of FIG. 1 serves to supply the tow tangentially into the gap 127 and is mounted on frame 1.

The operation of the embodiment is the same as that of FIG. 1. However, the FIG. 2 embodiment is especially well suited for cutting up large-diameter fibrous tows because the cutting length is practically identical for all fibers irrespective of whether they are cut at the lower or at the upper end of the cutting edge 112, due to the essentially vertical arrangement of the blades 111. This means that the edges 112 can be made rather long and are thus able to cut large-diameter tows.

Figure 3:
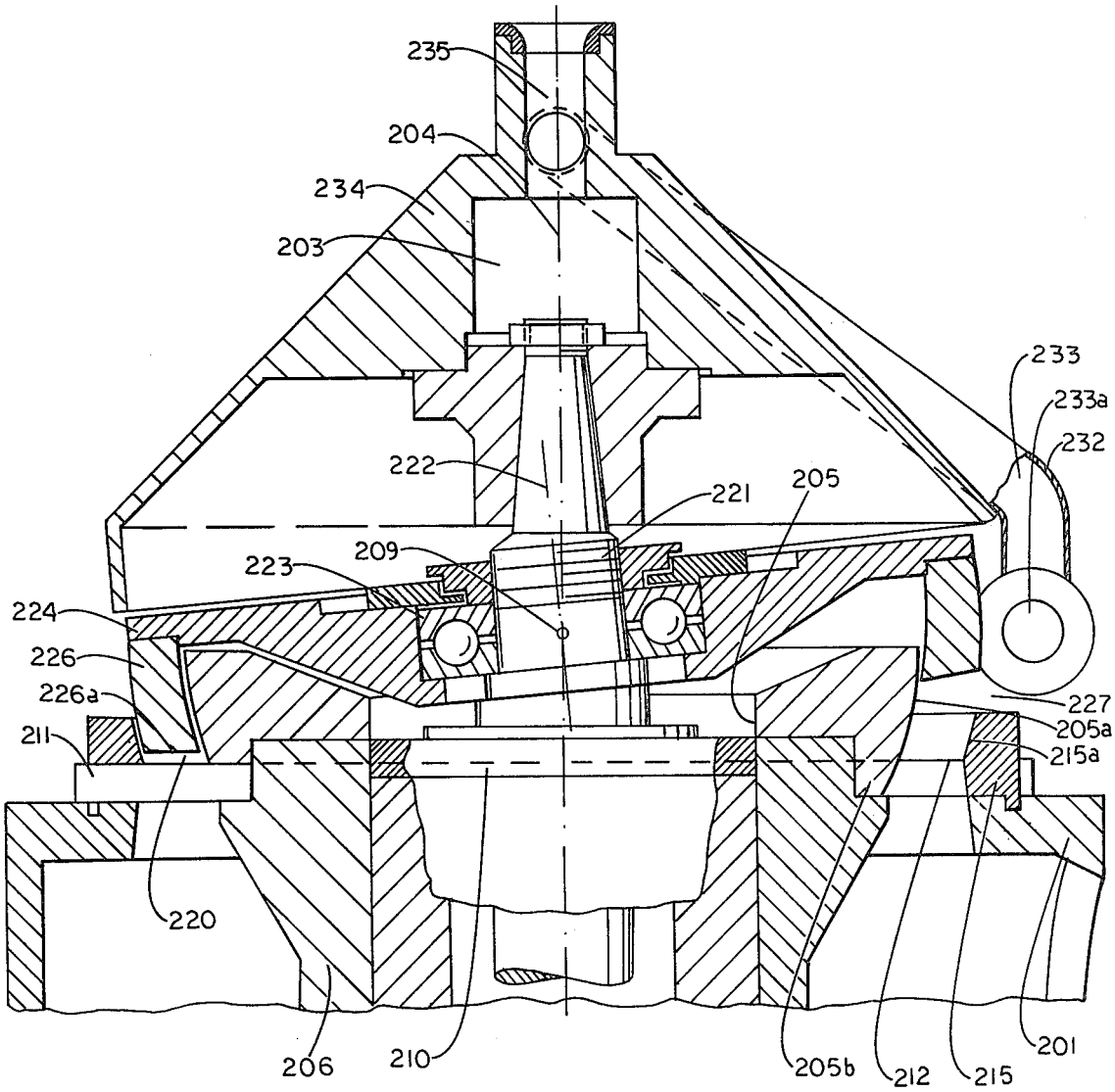
FIG. 3 is a view analagous to FIG. 2 but showing still another embodiment of the invention.

Still another embodiment is shown in FIG. 3 where the blade carrier 205 is a ring which is mounted (e.g., by screws) on a stationary hollow member 206 of cylindrical shape. The periphery of ring 205 is shaped as a part-spherical zone 205*a* having a center of curvature located only slightly above the plane of the upper edge of zone 205*a*. The lower side of ring 205 is provided with an annular collar 205*b* formed with circumferentially spaced slots in which the radially oriented blades 211 are received while cutting edges 212 face upwardly in the drawing. The cutting edges 212 are located in a plane 210 which is spaced from the center 209 by a distance corresponding to about one-third of the radius of the (imaginery) sphere of which zone 205*a* forms a part. A slotted ring 215 secures the radially outer ends of blades 211 on an edge portion bounding a circular opening in a machine housing 201. The inner surface of ring 215 is shaped to resemble a part 215*a* of a hollow sphere and spaced from the zone 205*a*, so that an annular channel 220 exists in front of the cutting edges 212.

A shaft 203 is journalled in the member 206, for rotation about axis 204 when driven by a (not-illustrated) electric motor. Shaft 203 has an offset 221 with a cylindrical outer contour; the axis 222 offset 221 is inclined to the axis 204 by about 5°. A circular disk is journalled on the offset 221 in anti-friction bearings 223 and carries a tow-pressing ring 226. The outer and inner surfaces of ring 226 are part-spherical in shape so that ring 226 can enter into the channel 220 with slight play. Due to the inclination of axis 222 the ring 226 enters at one side into the channel 220 but leaves a free gap 227 at the opposite side.

A flyer 232 is mounted on the end of shaft 203, above the offset 221. In the usual manner, it has a curved tube 233 which has one end axially and the other end tangentially oriented. Tube 233 is mounted on a hood 234 which straddles the disk 224 like an inverted funnel. The tangential end 233*a* of tube 233 is located adjacent the gap 227.

The tow to be cut is here supplied axially via the inlet 235. The rotating flyer 232 deflects the tow and deposits it on the stationary surface 205*a* in form of convolutions which are pushed towards the cutting edges 212 by the action of the ring 226. The ring 226, together with the disk 224, portions a tumbling movement with its axis 222 precessing about the axis 204. At any given movement during the operation of the incline, the location at which the endface 226*a* of ring 226 comes closest to cutting edges 212 is offset by about 180° from the location at which the tow is deposited on the surface 205*a* by the flyer 232. While tumbling with the ring 226, the disk also rotates slowly about the axis 222 so that the ring 226 rolls on the stationary tow convolutions instead of sliding over them (avoidance of sliding friction). In other words, in this embodiment, as in the others, the rotary speed of ring 226 is automatically accommodated to that of the blade carrier 205 (in this case zero) so as to avoid sliding friction. The staple fibers resulting from cutting of the tow by the blades 211, drop into the lower annular space and can be removed from there, for example, laterally by means of suction.

The invention is susceptible of various modifications. Thus, for example, the angle included between the mutually inclined axes need not be 5°, but may be from about 2° to about 20°.

While the invention has been illustrated and described as embodied in a tow cutting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a machine for producing staple fibers by cutting a travelling tow, a combination comprising a rotationally symmetrical blade carrier having a circumferential first surface shaped in conformance with a portion of a sphere; a plurality of cutting blades on said carrier, circumferentially distributed thereabout and having portions projecting therefrom; a mounting ring secured on said portions of said blades and having a circumferential second surface shaped in conformance with a portion of a hollow sphere concentric to said first surface and defining therewith an annular channel across which said blades extend; a tow pressing ring extending at one side of said channel into the same and close to said blades and being at the opposite side of said channel located outside the same and in part defining a tow inlet gap communicating with said channel, said pressing ring having an axis which is inclined to an axis of said blade carrier and intersects it at the center of curvature of said spheres; and means rotatably mounting at least one of said blade carrier and pressing ring with freedom of adjusting its speed of rotation to the other of said pressing ring and blade carrier, respectively.

2. A combination as defined in claim 1, wherein said axes include with one another an angle of between about 2° and 20°.

3. A combination as defined in claim 2, and further comprising means for changing said angle included between said axes.

4. A combination as defined in claim 2, and means for further changing said angle included between said axes by tilting said pressing ring about a pivot extending normal to said axes.

5. A combination as defined in claim 1, further comprising an inwardly directed annular nozzle coaxial to said blade carrier at a side of said blades which is remote from said pressing ring; and means for supplying compressed gaseous fluid to said nozzle.

6. A combination as defined in claim 1, said blades having cutting edges facing towards said pressing ring; and further comprising a cap over said blade carrier at a side thereof remote from said cutting edges and shaped to define with said first surface a calotte configuration.

7. A combination as defined in claim 1, further comprising means for rotating said blade carrier about said axis thereof, said pressing ring being turnable about its axis which is stationary; and stationary means for tangentially admitting the tow to be cut into said inlet gap.

8. A combination as defined in claim 7, wherein said pressing ring is freely turnable independently of said blade carrier.

9. A combination as defined in claim 1, said blade carrier being stationary; and further comprising a flyer for supplying tow to be cut, said axis of said pressing ring forming with an axis of said flyer a rigid system, and said pressing ring being freely turnable about said axis thereof.

10. A combination as defined in claim 1, said blades having cutting edges which include with said axis of said blade carrier a plus angle of 90°.

11. A combination as defined in claim 1, said blades having cutting edges which include with said axis of said blade carrier a minimum angle of 10°.

12. A combination as defined in claim 1, said blades having cutting edges which include with said axis of said blade carrier an angle of exactly 90°.

13. A combination as defined in claim 12, said cutting edges being located in a common plane which is spaced from the center of curvature of said part-spherical first surface by a distance corresponding to between 0.2–0.4 times the radius of the sphere.

14. A combination as defined in claim 1, said blades having cutting edges which include with said axis of said blade carrier an angle of between 0° and 20°.

15. A combination as defined in claim 14, said cutting edges being located in a common plane which is spaced from the center of curvature of said part-spherical first surface by a distance corresponding to between 0.6–0.8 times the radius of the sphere.

* * * * *